US005738186A

United States Patent [19]

Jones

[11] Patent Number: 5,738,186

[45] Date of Patent: Apr. 14, 1998

[54] EXTENSIBLE LADDER

[75] Inventor: Ronald Barry Thomas Jones, Glen Maye, Isle of Man

[73] Assignee: Foxdale Developments Limited, Glen Maye, Isle of Man

[21] Appl. No.: 704,525

[22] PCT Filed: Feb. 28, 1995

[86] PCT No.: PCT/GB95/00429

§ 371 Date: Sep. 12, 1996

§ 102(e) Date: Sep. 12, 1996

[87] PCT Pub. No.: WO95/23907

PCT Pub. Date: Sep. 8, 1995

[30] Foreign Application Priority Data

| | | | |
|---|---|---|---|
| Mar. 1, 1994 | [GB] | United Kingdom | 9403863 |
| Nov. 17, 1994 | [GB] | United Kingdom | 9423238 |

[51] Int. Cl.[6] ..... E06C 1/00

[52] U.S. Cl. ..... 182/195; 182/207

[58] Field of Search ..... 182/195, 207, 182/209, 210, 211, 228

[56] References Cited

U.S. PATENT DOCUMENTS

| | | | |
|---|---|---|---|
| 667,927 | 2/1901 | Weeks | 182/195 |
| 1,712,942 | 5/1929 | Smith | 228/30 |
| 2,127,949 | 8/1938 | Zeman | 182/195 X |
| 2,542,398 | 2/1951 | Crumpton | 228/39 |
| 2,760,706 | 8/1956 | Pearl | 228/18 |
| 2,827,216 | 3/1958 | Napolitano | 228/39 |
| 2,957,543 | 10/1960 | Larson | 182/211 |
| 2,993,561 | 7/1961 | Watson | 182/195 |
| 3,451,506 | 6/1969 | Neal | 182/195 |
| 3,653,463 | 4/1972 | Neal et al. | 182/195 |
| 3,692,143 | 9/1972 | Kummerlin et al. | 182/24 |
| 3,784,020 | 1/1974 | Steiner | 182/195 X |
| 3,997,026 | 12/1976 | Riehlmann | 182/18 X |
| 4,119,177 | 10/1978 | Andersson | 182/195 |
| 4,574,918 | 3/1986 | Marques | 182/164 |
| 5,467,827 | 11/1995 | McLoughlin | 169/24 |

FOREIGN PATENT DOCUMENTS

| | | |
|---|---|---|
| 192123 | 8/1986 | European Pat. Off. . |
| 0192123 | 8/1986 | European Pat. Off. . |
| 2415715 | 8/1979 | France . |
| 73768 | of 1892 | Germany . |
| 1563049 | 3/1980 | United Kingdom . |
| 1570200 | 6/1980 | United Kingdom . |
| 2118237 | 10/1983 | United Kingdom . |
| 2277952 | 11/1994 | United Kingdom . |
| 9115651 | 10/1991 | WIPO . |
| 9302271 | 2/1993 | WIPO . |

*Primary Examiner*—Alvin C. Chin-Shue
*Assistant Examiner*—Richard M. Smith
*Attorney, Agent, or Firm*—Edwin D. Schindler

[57] ABSTRACT

An extensible ladder includes a plurality of sections, each having a pair of tubular uprights connected by a rung, with the uprights of each section being slidably engaged with the corresponding uprights of an adjacent section. The inside surface of the tubular uprights are provided with longitudinally extending grooves, which reduce the area of sliding contact between adjacent uprights, thereby making the ladder easier to extend or collapse.

11 Claims, 5 Drawing Sheets

EXTENSIBLE LADDER

This invention relates to an extensible ladder.

Various types of extensible ladder have been proposed hitherto. U.S. Pat. No. 1,712,942 discloses one such ladder comprising a plurality of sections each having a pair of tubular uprights connected at their upper ends by a rung, with the tubular uprights of each section being a sliding fit with the corresponding uprights of the adjacent sections.

The adjacent uprights need to be a tight fit with each other, so that the ladder is rigid when it is erected. However, this tight fit makes the ladder extremely difficult to extend and collapse. The sliding areas of contact between adjacent upright sections wear with prolonged use, and thus the ladder becomes increasingly less rigid. Any dust or swarf that gets trapped between the uprights will cause the ladder to jam when it is being collapsed or extended.

We have now devised an extensible ladder which alleviates the above-mentioned problems.

In accordance with this invention there is provided an extensible ladder comprising a plurality of sections, each section having a pair of uprights connected by a rung, with the uprights of each section being slidably engaged with the corresponding uprights of an adjacent section, the uprights being formed with longitudinally extending grooves which reduce the area of sliding contact between adjacent uprights.

The friction between adjacent uprights is greatly reduced owing to the grooves reducing the area of sliding contact between them. This makes the ladder very much easier to extend or collapse than conventional extensible ladders. The areas of sliding contact between adjacent uprights do not wear as badly as conventional extensible ladders, and thus the ladder does not suffer from the problems of poor rigidity. Any dust or other particles that get caught between the uprights will collect in the grooves rather than between the areas of sliding contact. The ladder is thus less prone to jamming.

Preferably the uprights are tubular or channel-section, the grooves being formed on the inside surfaces of the uprights, so that they are hidden from view.

It is known to apply oil or other liquid lubricants to the uprights of extensible ladders to reduce the sliding friction, thereby making the ladder easier to extend and collapse. This lubrication is messy, since it gets on the hands and clothes of persons climbing the ladder. Furthermore, in time the lubrication becomes discoloured, and thus stains any objects which come into contact with the ladder.

Thus, preferably a dry friction-reducing coating, such as polytetrafluoroethylene (PTFE), is applied to the areas of sliding contact of the uprights of the ladder sections.

Preferably the sections of the ladder can be separated from each other, so that they can be cleaned, and so that damaged sections can be replaced.

When a person climbs a ladder, a considerable amount of downwards force is applied to the rungs. Thus, the rungs need to be securely attached to the uprights. Generally in conventional non-extensible ladders, the rungs extend through tubular uprights so as to form a rigid connection therebetween. It is not possible to construct extensible ladders in this way, since the rungs would obstruct the sliding action of the uprights. Preferably the rungs are therefore attached to the outside of the tubular uprights by welding. Some materials, particularly aluminium, are not easy to weld whilst maintaining necessary tolerances. It will be appreciated that the tolerances involved in constructing extensible ladders are critical, for example if the distance between the opposite uprights of each section is not exactly correct, then the sections of the ladder will not fit together properly. However, these accurate tolerances can be achieved using jigs and robotic welding apparatus.

The rungs of U.S. Pat. No. 1,712,942 are welded to the uprights, and it will be appreciated that the welds need to penetrate into respective areas of the uprights and rungs, so that a strong connection is formed therebetween. A disadvantage of weld penetration is that distortion or over penetration occurs inside the uprights, which interferes with the sliding action of the ladder.

We have found that the grooves serve to accommodate a large proportion of any distortion caused by weld penetration.

However, preferably the rungs are welded to the uprights at points on the outside surfaces of the uprights which correspond to the grooves on the inside surface of the uprights. Thus, any distortion or over penetration which occurs in the uprights will be confined to the grooves, and thus will not interfere with the sliding action of the ladder Preferably the rungs and uprights are cut from extrusions of e.g. aluminium. Preferably the rungs are tubular.

Preferably the rungs are mounted such that at least the front edge thereof is spaced from the end of the uprights from which the adjacent section slides, the rung of the adjacent section resting against said end of the uprights when the ladder is collapsed. Thus, when the ladder is collapsed, the user avoids trapping his fingers between the adjacent uprights, because the front edge of the rung is spaced from the end of the uprights.

An embodiment of this invention will now be described by way of example only and with reference to the accompanying drawings, in which.

Referring to FIGS. 1 to 4 of the drawings, there is shown an extensible ladder which is formed from extruded aluminium components and is light in weight. The ladder comprises a plurality of sections A–n which are telescopically engaged with each other. Each section comprises a pair of tubular uprights 10, which are generally rectangular in cross-section, and which are interconnected at their upper ends by a tubular rung 11.

Figure 5:
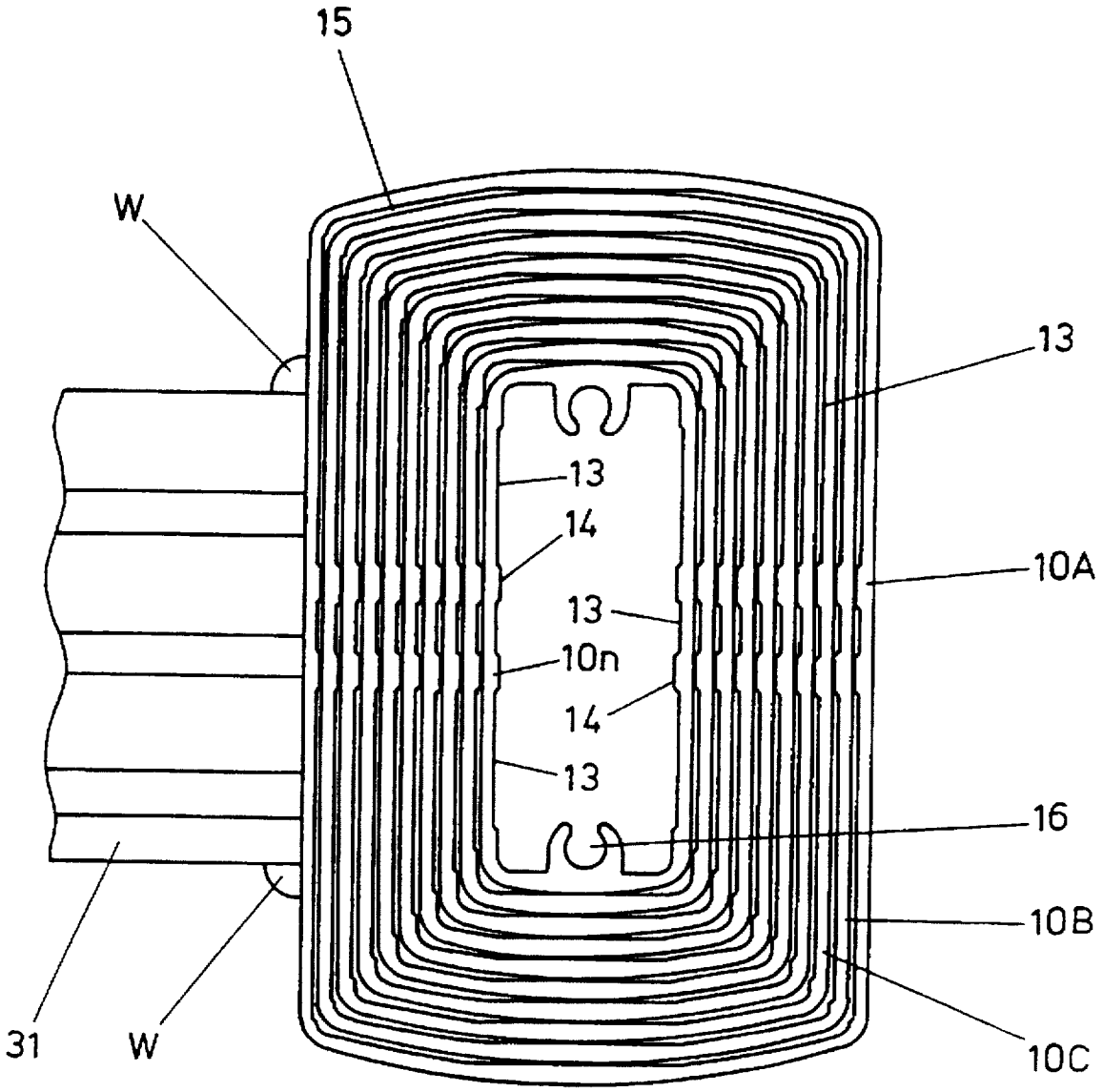
FIG. 5 is a sectional view along the line V—V of FIG. 1.

Referring to FIG. 5 of the drawings, the uprights 10 of each section have longitudinally extending grooves 13 formed on their inside surfaces, and defining ribs 14 between the grooves 13. The uprights 10 of each section of the ladder engage, as a close but sliding fit, into the uprights of the ladder section below. The front edge of the rung 11 of each section is spaced from the top of the upright of that section, such that the rung 11 slopes upwardly from front to back when the ladder is vertical. The uprights 10 of each section are all the same height as each other, but are progressively smaller in cross-section towards the top section. When the ladder is extended, the rungs 11 are all an equal distance apart from each other.

In extending or collapsing the ladder, the ribs 14 form the area of sliding contact between adjacent uprights. A layer (not shown) of hard wearing friction-reducing material is disposed over the outside of each of the uprights, so as to reduce the friction between the sliding aluminium uprights. The material is preferably of a type which transfers onto areas which come into contact with the layer.

Front and rear walls of each upright 10 are convex, and are arranged to contact the corresponding upright of the ladder section below at their radially outermost part only. Thus, longitudinally extending spaces 15 are formed between the corners of the adjacent uprights. These areas of contact on the front and rear walls are also coated with the above-mentioned friction-reducing material.

The uppermost section comprises uprights 10*n* which are formed with a longitudinally extending channel 16 on their front and rear walls, which serve to strengthen the uppermost section.

Figure 6:
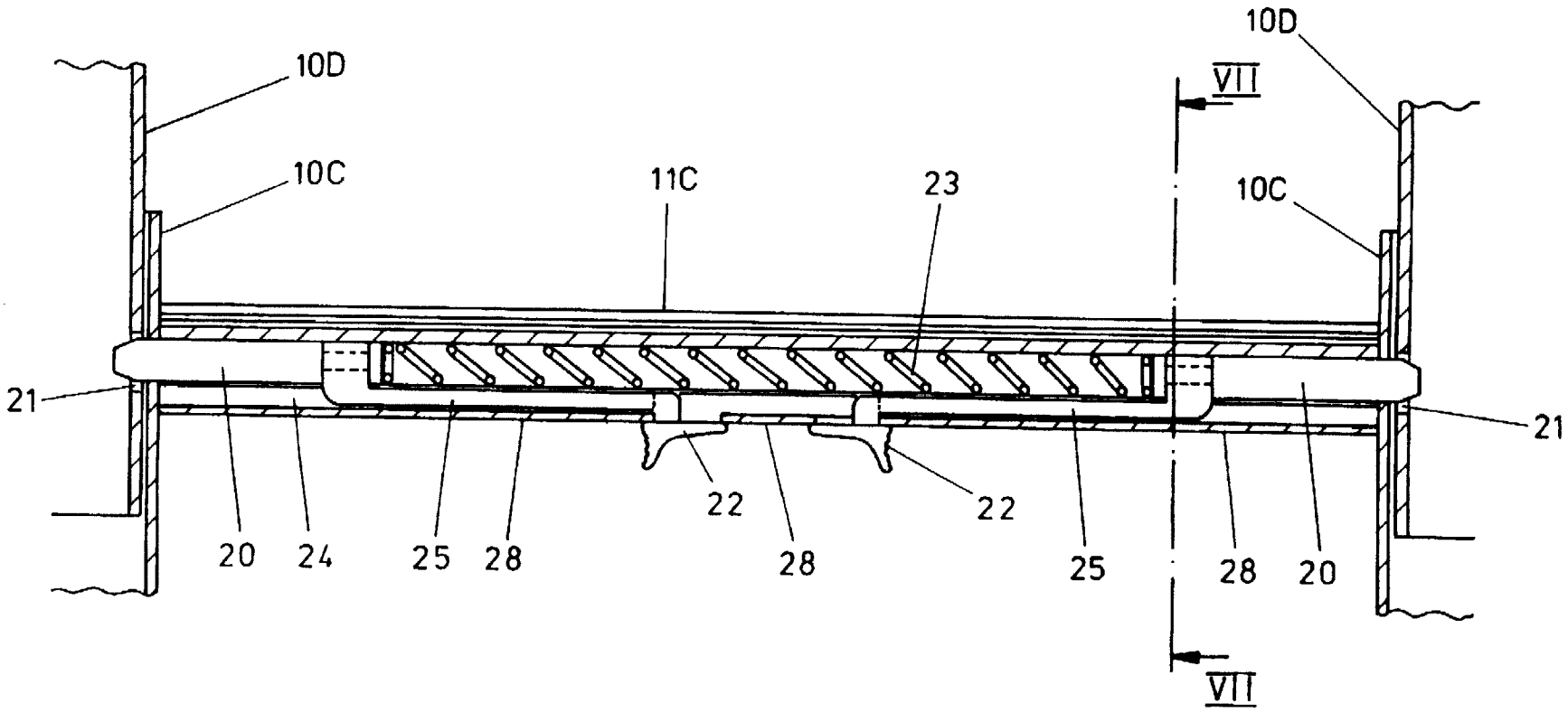
FIG. 6 is a longitudinal sectional view through a rung of the ladder of FIG. 1.

Referring to FIG. 6 of the drawings, when the ladder is extended, spring-loaded circular-section metal bolts 20 in the rungs 11 engage within apertures 21 formed towards the lower end of the inner walls of the uprights of the ladder section above. Thus, in order to extend the ladder, the top ladder section is pulled out until the spring-loaded bolts 20 of the ladder section below spring into its locking apertures 21, then the next section is pulled out, and so on. Preferably the bolts 20 are coated with a layer of hard wearing friction-reducing material.

In order to collapse the ladder, the bolts 20 of the top ladder section are retracted, so that its uprights 10*n* can drop into the uprights of the ladder section below, then the bolts of that section are retracted and so on. In order to retract the bolts 20 of each ladder section, each bolt 20 is provided with a plastics release catch 22, which projects downwardly from the underside of the rung 11.

Figure 7:
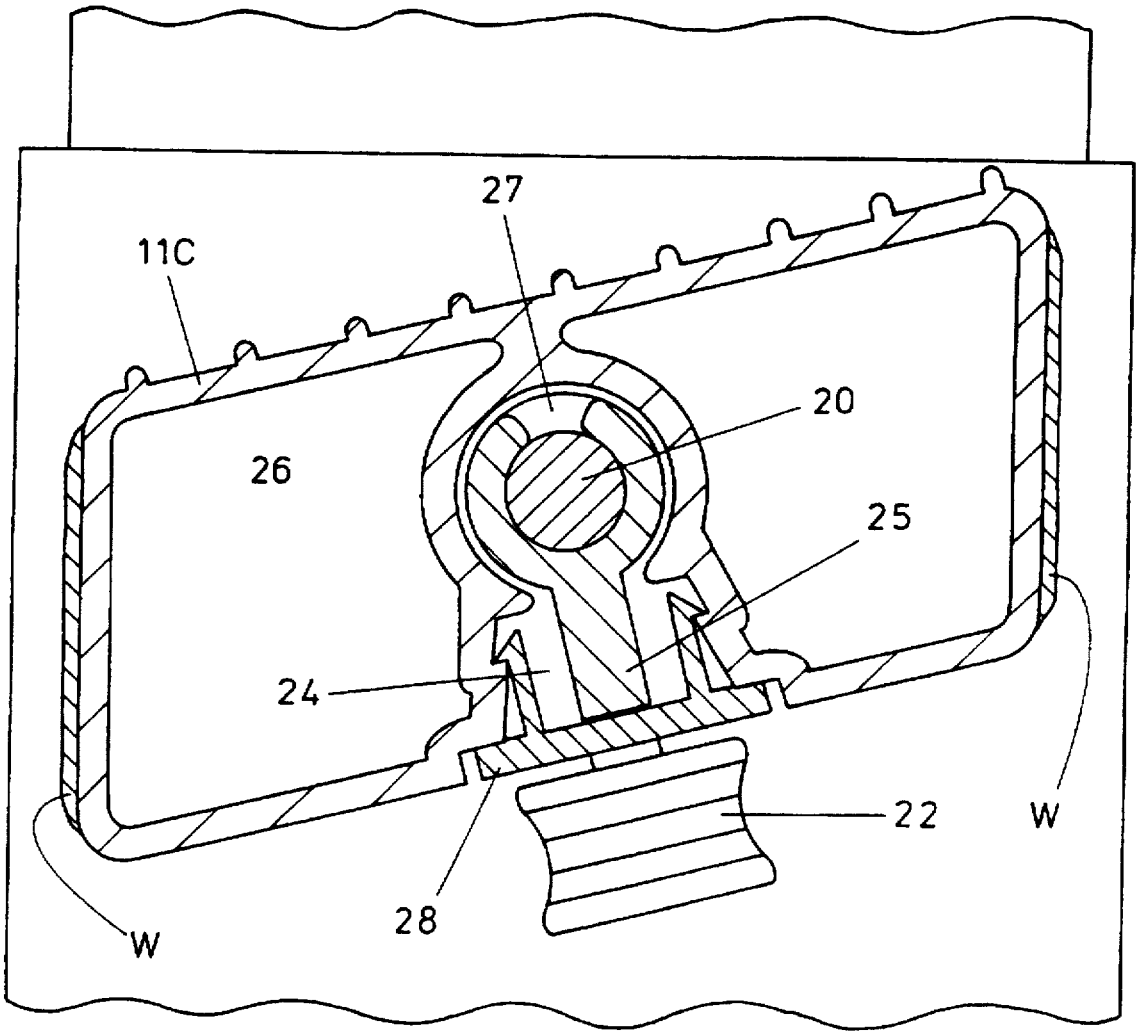
FIG. 7 is a sectional view along the line VII—VII of FIG. 4.

As shown in FIG. 7, each rung e.g. 11*c* comprises a tubular rectangular-section extrusion having a channel-section longitudinally extending slot 24 on its underside. The locking bolts 20 are slidably mounted in a substantially circular-section portion at the base of the slot 24. A helical spring 23, also disposed in the base of the slot 24, acts between the bolts 20 so as to bias them outwardly from respective opposite ends of the rung 11*c*.

The plastics release catches 22 are connected to respective bolts 20 by means of an elongate arm 25 which extends longitudinally along the neck of the slot 24. The outer end of each arm 25 comprises a C-shaped clip 26, which engages with a peripheral groove 27 formed on the inner end of the bolt 20. Three flat plastics covering strips 28 snap-engage into a recess formed in the opening of the slot 24 on each rung, so as to conceal the bolt and catch mechanism inside.

The uprights 10A of the lowermost section are interconnected at their lower ends by an extra rung 31. Each of the rungs 11A–11*n*, 31 are attached to the uprights by welds. The uppermost rung 11*n* projects outwardly from the uprights 10*n*, and in use forms a stabiliser which rests against a wall or other flat structure. Opposite ends of the uppermost rung 11n are provided with rubber end-caps 32. The foot of the ladder is also provided with rubber feet 33.

Figure 2:
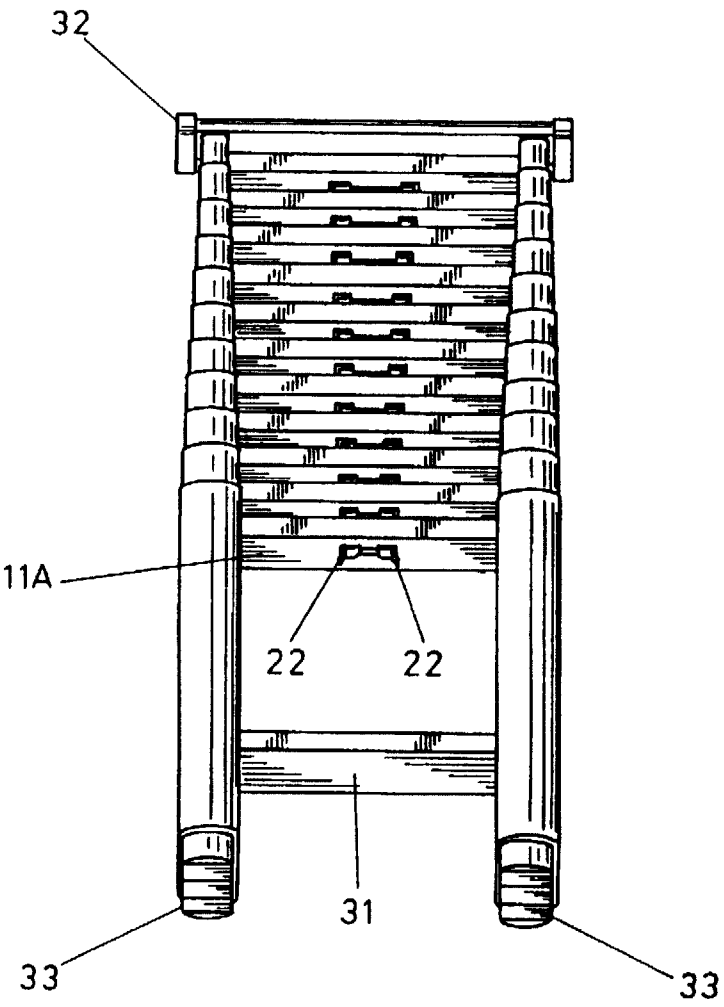
FIG. 2 is a perspective rear view of the ladder of FIG. 1, when the ladder is collapsed.
Figure 1:
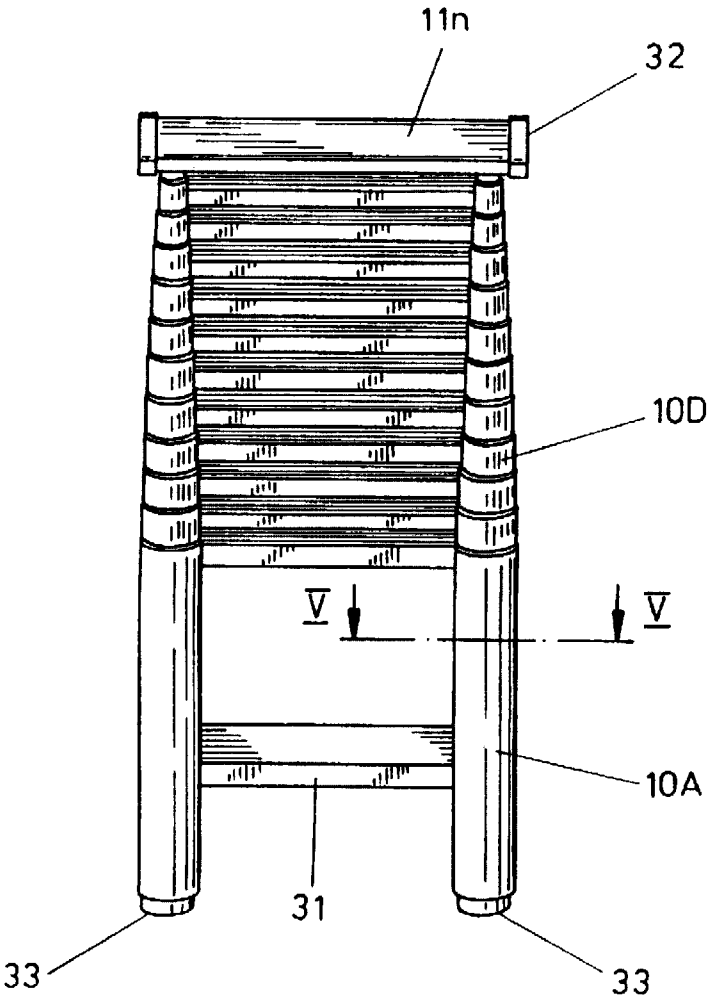
FIG. 1 is a front view of an extensible ladder in accordance with this invention, when the ladder is collapsed.
Figure 3:
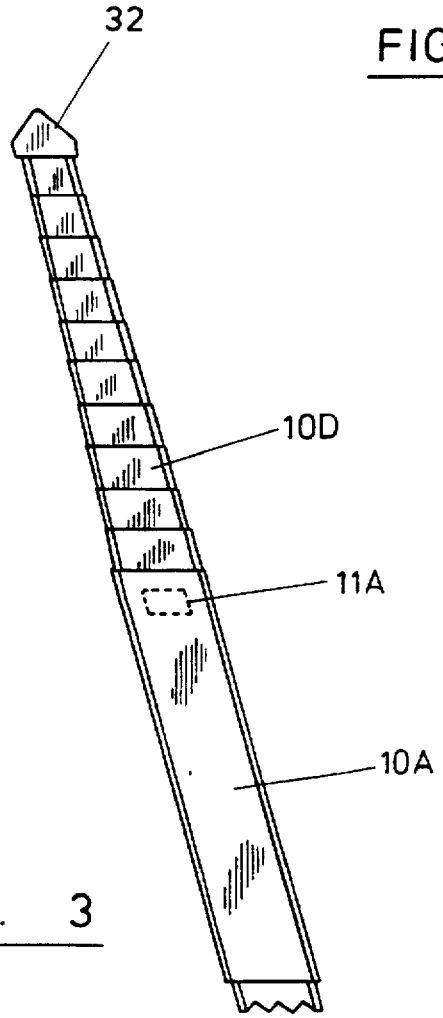
FIG. 3 is a side view of the ladder of FIG. 1, when the ladder is collapsed.
Figure 4:
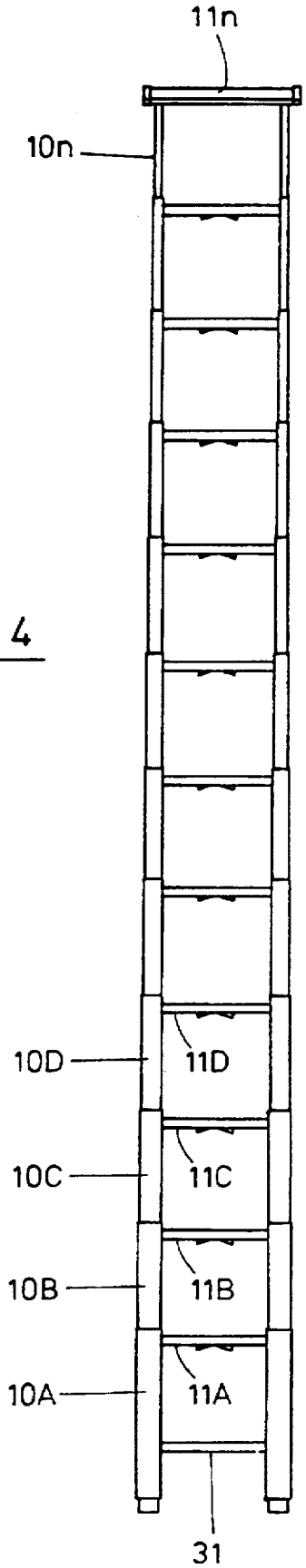
FIG. 4 is a perspective view of the ladder of FIG. 1, when the ladder is extended.

Each rung 11 is welded to respective uprights 10 along its front and rear faces only, as denoted by W in FIGS. 3 and 5. The welds connect the rungs 11 to the outside surfaces of the uprights 10 at points which correspond to the longitudinally extending spaces 15 on their inside surfaces. Thus, any distortion caused by weld penetration will be confined to the longitudinally extending spaces 15, and will thus not interfere with the sliding action of the ladder.

In use, when the ladder is stood against a wall or other structure, the inclined upper surface of the rungs 11 assume a horizontal position. The ladder does not bend excessively when it is climbed, owing to the tight fit between adjacent uprights of the ladder sections. However, the friction-reducing coating prevents this tight fit between the uprights from making the ladder difficult to extend and collapse.

It will be appreciated that the ladder is particularly compact when it is collapsed, yet it can be extended very quickly and easily to form a versatile rigid ladder.

I claim:

1. An extensible ladder comprising a plurality of sections, each section having a pair of tubular uprights which comprise substantially flat parallel side walls and convex front and rear walls, the side walls of the respective uprights of each section being connected by a rung, with the uprights of each section being telescopically engaged with the corresponding uprights of an adjacent section, the uprights being formed with longitudinally extending grooves which reduce the area of sliding contact between adjacent sections.

2. An extensible ladder as claimed in claim 1, in which the front and rear walls of each upright contact the corresponding uprights of adjacent sections at their radially outermost part only.

3. An extensible ladder as claimed in claim 2, in which longitudinally extending spaces are formed between corners of the adjacent uprights.

4. An extensible ladder as claimed claim 1, in which the grooves are formed on the inside surfaces of the uprights.

5. An extensible ladder as claimed claim 1, in which the rungs are welded to the uprights.

6. An extensible ladder as claimed claim 1, in which the uprights and rungs are formed from aluminium.

7. An extensible ladder as claimed in claim 6, in which the uprights and rungs are cut from extrusions of aluminium.

8. An extensible ladder as claimed claim 1, in which a dry friction-reducing coating is applied to areas of sliding contact of the uprights of the ladder sections.

9. An extensible ladder as claimed in claim 8, in which the coating comprises polytetrafluoroethylene (PTFE).

10. An extensible ladder as claimed claim 1, in which the sections of the ladder are separable from adjacent sections.

11. An extensible ladder as claimed claim 1, in which the rungs are mounted such that at least the front edge thereof is spaced from the end of the uprights from which the adjacent section slides, the rung of the adjacent section resting against said end of the uprights when the ladder is collapsed.

* * * * *